US006705399B1

(12) United States Patent
Ivannikov et al.

(10) Patent No.: US 6,705,399 B1
(45) Date of Patent: Mar. 16, 2004

(54) METHOD FOR TRANSFORMING A GAS-LIQUID STREAM IN WELLS AND DEVICE THEREFOR

(75) Inventors: Vladimir Ivanovich Ivannikov, Moscow (RU); Ivan Vladimirovich Ivannikov, Moscow (RU)

(73) Assignee: BIP Technology Ltd., Limassol (CY)

( * ) Notice: Subject to any disclaimer, the term of this patent is extended or adjusted under 35 U.S.C. 154(b) by 0 days.

(21) Appl. No.: 10/129,028

(22) PCT Filed: Nov. 1, 2000

(86) PCT No.: PCT/RU00/00435

§ 371 (c)(1),
(2), (4) Date: Apr. 29, 2002

(87) PCT Pub. No.: WO01/33038

PCT Pub. Date: May 10, 2001

(30) Foreign Application Priority Data

Nov. 2, 1999 (RU) ..... 99123083

(51) Int. Cl.[7] ..... E21B 43/38

(52) U.S. Cl. ..... 166/265; 166/105.5; 166/109; 166/372

(58) Field of Search ..... 166/265, 369, 166/370, 372, 105.5, 105.6, 109, 53, 54

(56) References Cited

U.S. PATENT DOCUMENTS 4,267,885 A 5/1981 Sanderford
RE30,836 E * 12/1981 Bunnelle ..... 96/214
4,515,608 A * 5/1985 Clegg ..... 96/198
4,708,595 A 11/1987 Maloney et al.

FOREIGN PATENT DOCUMENTS

RU 1117395 2/1983
RU 2029073 6/1991
RU 2096588 11/1994

OTHER PUBLICATIONS

I.M. Muraviev and N.N. Repin, "Research of Motion of Multicomponent Mixtures in Wells", Nedra, Moscow, 1972, pp. 129–139.
Yu. V. Zaitsey, "Theory and Practice of Gas Lift", Nedra, Moscow, 1987, pp. 67–71.

* cited by examiner

*Primary Examiner*—Zakiya Walker
(74) *Attorney, Agent, or Firm*—Collard & Roe, P.C.

(57) ABSTRACT

A method and device for forming a preferred gas liquid flow structure via separation of liquid and gas phases. The method and device relate to the production of gas and oil in wells. The operation and spacing of the devices ensure that the quantity of liquid moved upward exceeds the quantity of liquid running downward. The devices are sequentially installed along a tubing column. A displacement chamber in the form of an upturned cup moves axially in the tubing column. The travel of the cup is defined and controlled by a formula. The cup can have side openings in its lower section and a flange in its upper section. The flange normally blocks gas exhaust openings in a sleeve secured between the ends of the tubing members. The flange can move axially along the tubing.

3 Claims, 5 Drawing Sheets

METHOD FOR TRANSFORMING A GAS-LIQUID STREAM IN WELLS AND DEVICE THEREFOR

CROSS REFERENCE TO RELATED APPLICATIONS

Applicants claim priority under 35 U.S.C. §119 of Russian Application No. 99123083 filed Nov. 2, 1999. Applicants also claim priority under 35 U.S.C. §365 of PCT/RU00/00435 filed Nov. 1, 2000. The international application under PCT article 21(2) was not published in English.

BACKGROUND OF THE INVENTION

1. Field of the Invention

This invention relates to gas and oil production from wells and can be employed for exploitation of oil-bearing formations on a stage of natural flowing of the wells and also in case of artificially supplying of compressed air into the wells for lifting oil via air-gas lift method.

2. Prior Art

There are three possible structures of gas-liquid mixtures in production wells where lifting of oil to the surface is enabled by a gas:

1. An emulsion or foam structure, which is characterized by a more or less uniform distribution of gas in liquid. The gas is present in the liquid in a form of small bubbles (smaller than diameter of the lift tubing);
2. A beaded or slugged structure. In the case of such structures most of the gas moves in the form of bubbles filling the whole cross-section of a tube and alternating with slugs of liquid;
3. An axial or annular structure. In the case of such structures most of the gas moves along the tube axis as a continuous flow (gas blast) and the liquid moves along the walls in the form of a thin layer.

For vertical and inclined flows one can refer to a Hewitt chart of regimes of flowing (FIG. 1).

A method is known to form an emulsion structure of a gas-liquid flow in a lift column and devices to disperse gas into liquid (I. M. Muraviev and N. N. Repin, Research of Motion of Multicomponent Mixtures in Wells, Nedra, Moscow, 1972, pp.129–139).

Its shortcomings are:

- from point of view of gas consumption the emulsion structure is not optimal;
- devices to disperse gas into a liquid are mounted at the bottom end of the lift column where gas is injected into the liquid. However the gas bubbles coalesce while they move upward causing the flow structure to be destroyed, i.e. it is not possible to obtain a stable structure by this method;
- creation of emulsion structure of a gas-liquid flow (especially if surface active substances are added) makes more difficult the subsequent separation of gas after the liquid (oil) has been lifted to surface.

A method is known to form a slugged regime of flowing in a gas-liquid mixture and devices therefor (Yu. V. Zaitsev et al., Theory and Practice of Gas Lift, Nedra, Moscow, 1987, pp. 67–71). This method is the closest to the proposed one in its technical essence. In specialized literature this method is known as a displacement lift and is realized as follows. At the lower end of the outer row of tubes in a two pipe lift column a displacement chamber is placed equipped with a reflux valve in which chamber a liquid is being accumulated, and after injecting into it of a gas the slug of the liquid is ejected into lift tubing and thus elevates. This process is periodically repeated. Variants of displacement lift can employ compressed gas cutoff either on a surface or bottomhole.

The main shortcomings of this prototype are:

- it is possible to create a beaded (slugged) regime of a flow at the initial path of a lift column, but very soon it decays and becomes chaotic because the gas bubbles go into regime of floating up (drifting) and do not perform the useful work all along the whole lift column;
- it is necessary to employ a two row lift column;
- the devices controlling the lift are rather sophisticated;
- high level of losses of compressed air;
- lift production capacity by liquid is limited;
- it can't be used in free flowing wells.

A device is known for periodic gas lift to elevate the liquid from wells (Authorship Certificate, USSR no 1117395, 03.02.83) that comprises a tubing column and a replacement chamber comprising an overflow nipple with a flange rigidly placed in the tubing column and a turned over cup placed above the said nipple and forming together with the nipple a chamber being in its lower part hydraulically connected with inner space of the tubing pipes.

This device being the most relevant by technical solution is the closest one to the proposed invention. Main shortcoming of the said known device is that the displacement chamber is made from rigidly connected elements and therefore its volume available to form a gas slug is limited. It does not provide a possibility of self-adjusting of a system of gas-liquid slugs to variation of parameters of the gas-liquid mixture or hydrodynamics of a rock-well system.

SUMMARY OF THE INVENTION

Technical result of the invention is providing of a possibility of self-adjusting of a system of gas-liquid slugs to respond variations in parameters of the gas-liquid mixture or hydrodynamics in a "rock-well" system. This technical result is achieved due to transformation of a gas-liquid flow in wells due to sequential placement of devices separating gas and liquid phases with intervals providing condition $q_{up}>q_{down}$, where $q_{up}$ is amount of liquid being elevated, and $q_{down}$ is amount of liquid draining down. A device for transforming of a gas-liquid flow in a well comprises a tubing column and a displacement chamber which chamber is made in a form of a turned over cup and an overflow nipple placed in the tubing column which cup and nipple form a chamber hydraulically connected in its lower part with the inner space of the tubing pipes, and according to this invention said cup is admitted to move axially and its travel path is defined and regulated by the following condition:

$$F>Vg(\rho_{liq}-\rho_{gas})-G-P_{stat},$$

where: F is a force rising the cup, V is a volume of gas in displacement chamber, G is the weight of the cup accounting for the fact that it is in liquid, $P_{stat}$ is a hydrostatic pressure on the cup, g is a gravitational acceleration, $\rho_{liq}$ and $\rho_{gas}$ are densities of the liquid and gas, respectively.

The technical result can be also achieved in a device wherein the displacement chamber is made in a form of a cup having side openings in its lower part and a flange on the top which flange normally closes the gas outlet passes in a sleeve rigidly connected at the pipe joint of the tubing column, and said flange is admitted to move axially within said sleeve.

DETAILED DESCRIPTION OF THE INVENTION

Figure 1:
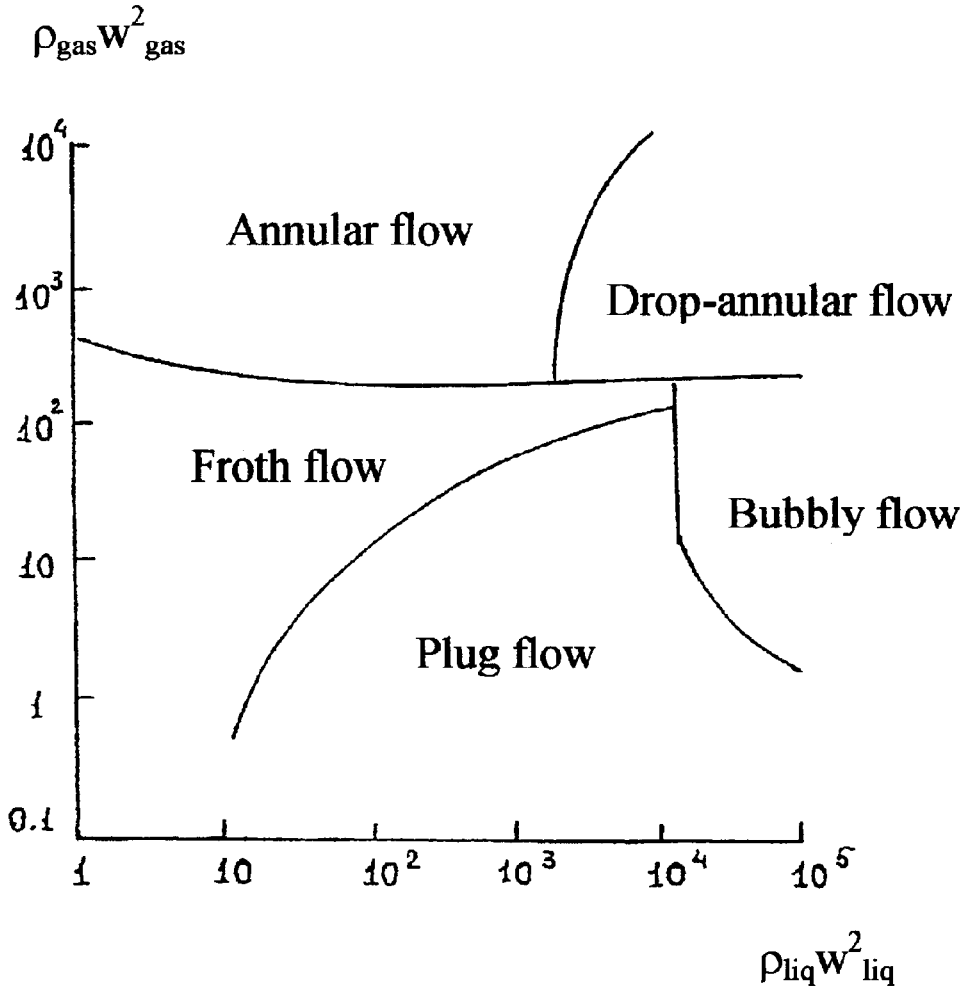
FIG. 1 shows a Hewitt chart of regimes of flowing plotted $\rho_{gas}w^2_{gas}$ versus $\rho_{liq}w^2_{liq}$, where $\rho_{liq}$ is density of liquid, $\rho_{gas}$ is density of gas, $w_{gas}$ is velocity of gas, $w_{liq}$ is velocity of liquid.
Figure 2:
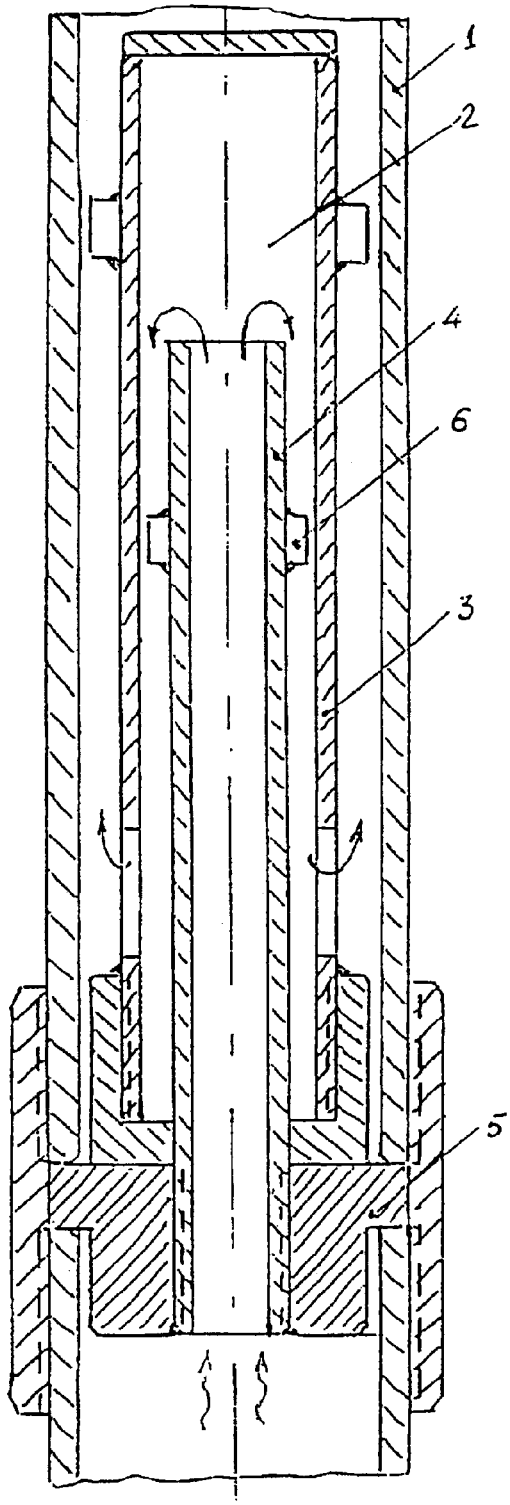
FIG. 2 shows a general view of a device to implement the proposed method. It comprises a column of tubing pipes 1, a displacement chamber 2 which is made in a form of a turned over cup 3 and an overflow nipple 4. To seat the device between tubes ends in the column 1 it has a setting flange 5. On an outer surface of the overflow nipple 4 the stoppers 6 are mounted to restrict the travel of the cup 3.

Device shown in the FIG. 2 operates as follows: a gas-liquid mixture moving upward enters into the device through a overflow nipple 4 rigidly positioned in a connection of pipes in column of tubing pipes 1, where gas separates and accumulates in the turned over cup 3 while the liquid overflows and accumulates outside the cup. Also the liquid drains down on the cup from tubes above the device. Thus both the gas and liquid slugs are formed. When volume of the gas slug in the cup 3 exceeds certain critical value, the cup starts moving up thus increasing the volume of gas chamber. This increase of volume allows to match the regime of operation of this device with hydrodynamics of the lift column which column is equipped with a garland of such devices. In a moment when volume and weight of drained liquid exceeds the gas pressure inside the cup 3, the gas slug will be expelled from the cup. Once it happens the cup will go down to seat on the flange 5 and then this process will be repeated.

Travel pass of the cup 3 is restricted in accordance with calculation of needed volume of the displacement chamber 2 for each particular location along the lift column. Stoppers 6 which are rigidly fixed on an outer surface of the overflow nipple 4 provide this restriction.

Admittance of a free travel of the turned over cup 3 allows variation of a gas slug volume and, once enough liquid drained on the cup, enables faster expelling of the gas slug into the lift column thus avoiding discontinuities in it what improves function of the device to form a beaded (slugged) structure of the gas-liquid flow.

Figure 3:
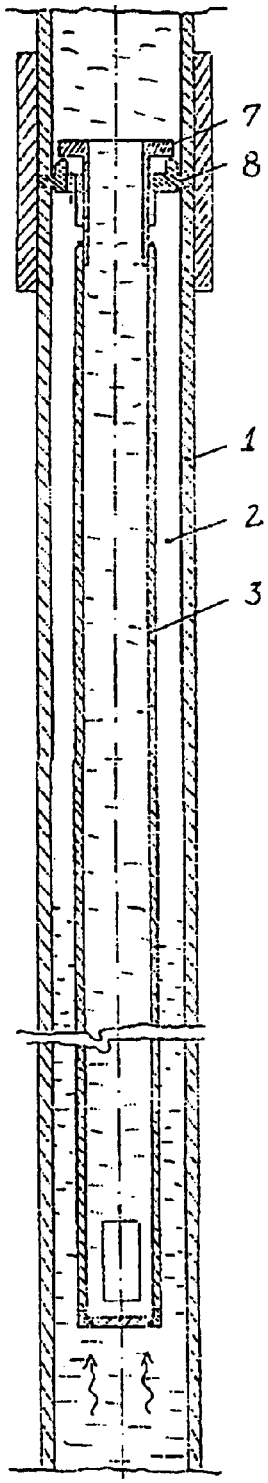
FIG. 3 shows another embodiment of a device to implement the proposed method. It comprises a column of tubing pipes 1, a displacement chamber 2 which is made in a form of a cup 3 having side openings 3*a* at its lower part and a flange-valve 7 on top of it which flange normally closes the gas outlet passes in a sleeve 8, and said flange-valve 7 is admitted to move axially in said sleeve 8.

Device shown in the FIG. 3 operates as follows: a gas-liquid mixture arriving from the bottom separates in the device by phases: the gas accumulates in an annular space between the cup 3 and a column of tubing pipes 1 and the liquid remains at lower level. Also the liquid drains down in the cup 3 from tubes above and then flows out through openings 3a in it downward. Once volume of gas in the annular space reaches a certain critical value the cup 3 will start moving up resulting in admitting a gas slug to eject. After gas slug is released the cup having a flange-valve 7 on top will seat back on the sleeve 8 and then this process will be repeated.

Figure 4:
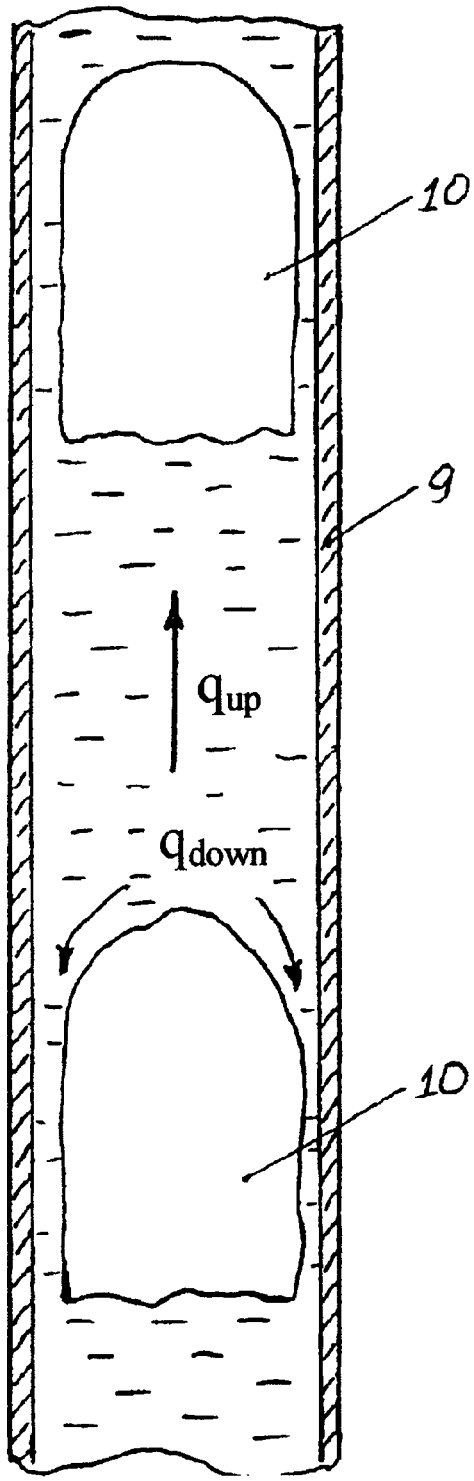
FIG. 4 shows process of motion of a gas-liquid flow in a slugging regime in a lift column 9, where $q_{up}$ is amount of liquid being elevated by a gas slug 10, and $q_{down}$ is amount of liquid draining down.

Let's consider the motion of a gas-liquid flow in the beaded regime along the lift column 9 (FIG. 4). The gas slug 10 is not a tight plug, so when it moves some liquid it pushes up ($q_{up}$) drains down along the pipe wall ($q_{down}$). When these two quantities equalize, i.e. $q_{up}=q_{down}$, the gas slug (bubble) will transfer to the regime of drifting (floating) up and no longer will perform any useful work. In that point the next such device shall be placed entrapping the gas bubbles, compressing them into a gas slug and ejecting it to perform work to lift the liquid.

Thus a compulsive forming of a beaded (slugged) structure of an upward flow of a gas-liquid mixture along a lift column 9 is provided.

Figure 5:
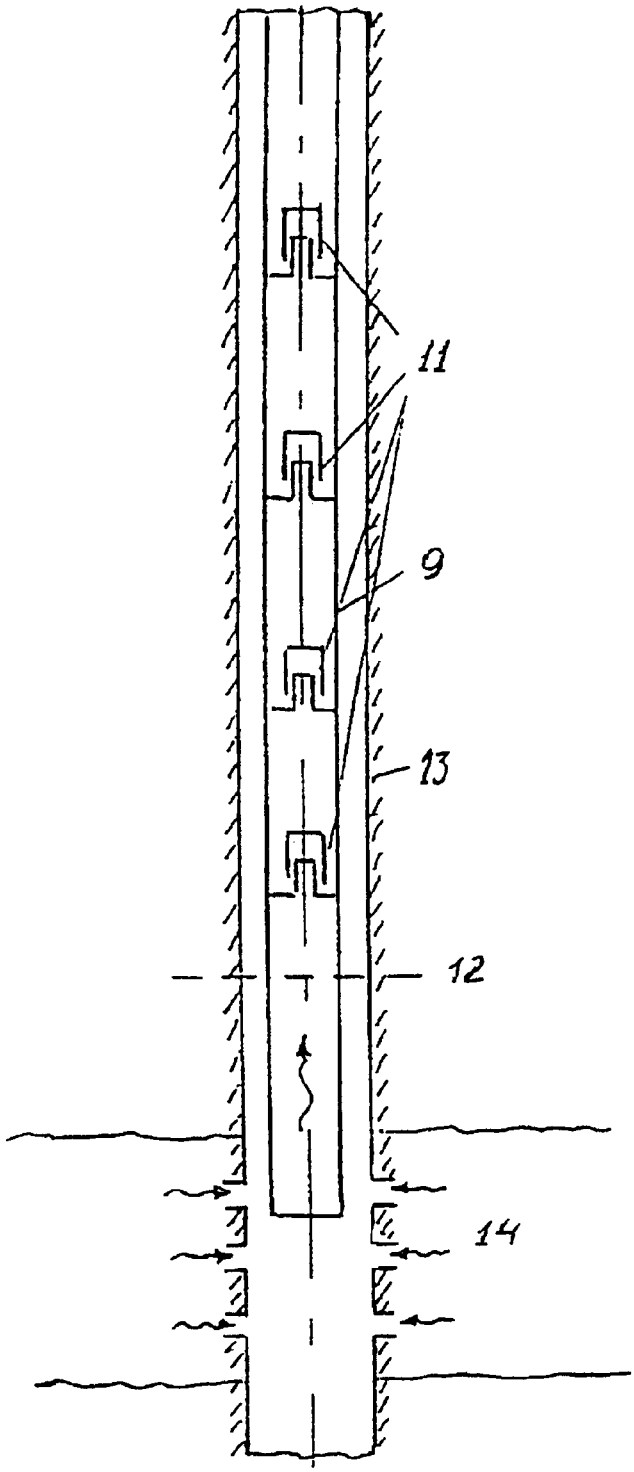
FIG. 5 shows a general view of a garland system of flow converters 11 in a lift column 9 where said garland system is placed above the level of oil degassing 12. Casing pipe 13 is connected with the oil-bearing rock 14 through the perforation holes.

FIG. 5 illustrates that such a process can be organized via a garland system of the flow converters 11, which is built into a lift column 9 and placed above the level of oil degassing 12. The number of the devices and layout of their placing along the column can be determined due to evaluations based on the above said conditions of their operation.

An oil well which flows an axial structure of the gas-liquid flow is most inefficient due to high losses of gas per unit volume of fluid produced from the well. The common practice of using of a surface or bottomhole flow bean doesn't significantly effect the structure of the flow and it just changes boundary conditions resulting in creation of a counter pressure on a rock thus suppressing oil production but still not avoiding gas release.

Equipping a flowing well with a system of slugging devices allows, as the filed tests show, a reduction of oil gas exhausts into atmosphere by 1.5–2 times minimum and increase oil production by 30–50% without essentially changing the parameters of the process.

Testing of a system of slugging devices in gas-lift wells shows that efficiency of lifting was increased by 2–3 times.

Additional advantages provided due to equipping the flowing and gas lift oil wells with said system of slugging devices are as follows:

- in contrast to the standard lift column with open lower end where the internal hydrostatic pressure is fully applied to a bottom hole (rock), in wells with lift column equipped with the system of slugging devices the hydrostatic pressure is distributed along the column. It provides more favorable conditions for oil inflowing at equal diameter of a surface bean. In gas-lift wells it makes it easier for the starting lift to operate;
- system of slugging devices splits a lift column into sections thus preventing liquid to drain to the hole bottom and therefore thus increasing the efficiency of liquid lifting;
- system of slugging devices operating to form a beaded structure of upward flow produces pressure pulsations in the lift column which is favorable to stimulate oil inflow from the rock;
- separation of phases taking place in a system of slugging devices (in contrast to their mixing in emulsified flow) makes degassing processes in gas separators (traps) easier and faster;
- system of slugging devices allows to reduce down to minimal values the losses of gas due to beaded structure of a gas-liquid flow comparing ones at axial or emulsion flow structures.

To enable current measurements to monitor wells and rocks it is advisable to leave one of the wells of an oil field non-equipped with the system of slugging devices as an observational one.

Strategic effect due to equipping of all flowing wells of an oil field with systems of slugging devices will result in extending of duration of a period of wells flowing by 1–2 years comparing the projected one depending on gas-oil ratio, degree of depletion of the deposit by reservoir elastic energy, reservoir oil volume, geological specifics of the deposit.

Additionally one can expect the increasing of cumulative oil recovery of oil deposits by about 10% comparing the projected values.

What is claimed is:

1. A method for transforming liquid-gas flow structure in a well, the method comprising:

lifting a liquid phase with a gas phase; and placing a plurality of devices for separating the liquid and gas phases along a lift column, wherein said plurality of devices are sequentially disposed along said lift column at intervals so as to provide a condition wherein $q_{up}>q_{down}$, where $q_{up}$ is an amount of liquid being elevated and $q_{down}$ is an amount of liquid draining down.

2. A device for transforming liquid-gas flow structure in a well, the device comprising:

a tubing column; and a displacement chamber disposed within said tubing column wherein a lower portion of said displacement chamber is hydraulically coupled with said tubing column, and wherein said displacement chamber comprises:

an overflow nipple; and an overturned cup capable of moving axially within said tubing column and having a travel path defined by a condition $$F>Vg(\rho_{liq}-\rho_{gas})-G-P_{stat},$$

where F is a force lifting said overturned cup, V is a volume of gas in said displacement chamber, G is a weight of said overturned cup in a liquid, $P_{stat}$ is a hydrostatic pressure acting on said overturned cup, g is a gravitational acceleration, and $\rho_{liq}$ and $\rho_{gas}$ are a density of the liquid and the gas, respectively.

3. A device for transforming liquid-gas flow structure in a well, the device comprising:

a tubing column;

a sleeve rigidly connected within said tubing column;

a displacement chamber movably disposed within said tubing column, wherein said displacement chamber comprises:

a cup having side openings disposed in a lower portion of said cup; and a flange disposed on an upper portion of said cup, wherein said flange is capable of moving axially within said sleeve and wherein said flange normally closes a gas outlet formed by said sleeve.

* * * * *